US007445398B2

(12) United States Patent
Stöckler

(10) Patent No.: US 7,445,398 B2
(45) Date of Patent: Nov. 4, 2008

(54) COUPLING SPRING PIN

(75) Inventor: Heinz Stöckler, Rüti (CH)

(73) Assignee: PATEA GmbH, Zug (CH)

( * ) Notice: Subject to any disclaimer, the term of this patent is extended or adjusted under 35 U.S.C. 154(b) by 0 days.

(21) Appl. No.: 10/898,066

(22) Filed: Jul. 23, 2004

(65) Prior Publication Data

US 2005/0019138 A1 Jan. 27, 2005

(30) Foreign Application Priority Data

Jul. 25, 2003 (EP) ..... 03016975

(51) Int. Cl.
*F16B 7/10* (2006.01)

(52) U.S. Cl. ..... 403/109.3; 403/109.8; 403/377; 403/379.5

(58) Field of Classification Search ..... 403/109.1, 403/109.2, 109.3, 109.6, 109.7, 109.8, 377, 403/378, 379.3, 379.4, 379.5, 328, 329; 285/7; 411/901; 24/453, 458
See application file for complete search history.

(56) References Cited

U.S. PATENT DOCUMENTS 2,620,210 A * 12/1952 Wuster ..... 403/377
3,712,652 A * 1/1973 Uilkema ..... 403/108
4,181,230 A * 1/1980 Acuff ..... 403/329
4,749,321 A * 6/1988 Knohl et al. ..... 411/371.1
4,830,035 A * 5/1989 Liu ..... 135/67
4,881,764 A * 11/1989 Takahashi et al. ..... 292/13
6,079,894 A * 6/2000 Obitts ..... 403/109.3
6,089,247 A 7/2000 Price
6,213,672 B1 * 4/2001 Varga ..... 403/109.2
6,263,895 B1 * 7/2001 Bang ..... 403/109.6

FOREIGN PATENT DOCUMENTS

EP 0 514 574 A1 11/1992
WO WO 02/08549 A1 1/2002

* cited by examiner

*Primary Examiner*—Michael P Ferguson
(74) *Attorney, Agent, or Firm*—Victor N. King; Speckman Law Group PLLC

(57) ABSTRACT

A coupling spring pin is provided for use in hollow sections or tubes. The coupling spring pin comprises a base spring element and a bolt connected to the spring element. The spring element is provided with a flange and at least two bent spring tongues. The bolt stands perpendicularly on the flange and the two bent spring tongues extend downwards from the flange. The bolt may be provided with a bolt case in order to securely prevent shearing. The bolt case, in its lower region, may be provided with an annular groove and the bolt case may be peripherally (injection) molded on the base in an injection molding tool, so that the plastic material of the flange may fill out the annular groove, which allows the bolt case to be connected to the spring element in an undetachable and stable manner.

12 Claims, 6 Drawing Sheets

PRIOR ART

COUPLING SPRING PIN

CLAIM FOR FOREIGN PRIORITY UNDER 35 U.S.C. § 119

This application claims foreign priority to European Patent Application No. 03'016'975.9, filed Jul. 25, 2003.

FIELD OF INVENTION

The present invention relates to a fixation pin and particularly to a coupling spring pin for use generally as a height-adjustable support leg or a corner post for a collapsible tent.

BACKGROUND OF THE INVENTION

Hollow sections, or tubes, capable of being displaced in one another in a telescopic manner may be used as height-adjustable support legs or corner posts with collapsible tents, as described in European patent EP-A-0'514'574. Octagonal telescopic tubes with grooves for accommodating keder sections are described in WO 02/08549. This type of tube is made of lightweight metal, preferably aluminum, with only the outer surfaces being anodized. The inner and outer tubes of the corner posts are provided with corresponding bores at predefined positions, and may be locked to one another in desired relative positions by way of fixation pins which are impinged by spring force. A well known type of a fixation pin manufactured as a single piece from a strip of sheet metal according to U.S. Pat. No. 6,089,247 is shown in FIG. 1. The free rear end of the spring steel sheet comes to bear on the inner side of the metal section, and, since the aluminum section is not anodized on the inside, this may lead to wear and slivers (chips). The worn-away aluminum particles may accumulate and settle between the inner and outer telescopic tube, and compromise the ability of the tubes to be displaced in one another. In the worst scenario, a mutual jamming, or blocking, of the tubes may occur.

The known fixation pins are not very stable with regard to their position and tend to "disappear" in the section when they have been completely pressed into the section. One cause of this originates from the V-shaped spring body which does not press the pin upwards in an exactly perpendicular manner, but also exerts components of forces which act in a transverse manner. It is important to users of the fixation pins that the pins are stable with regard to position. Stability of fixation pins has been achieved in the current state of the art, as shown in FIG. 1, wherein the rear end of the spring is welded or soldered on the hollow section in order to prevent the dislocation. This may only be accomplished, however, with fixation pins having hollow section at the end. If the fixation pins have to be positioned further to the inside in the section, then they may only be fixed in this manner with a considerable expense. Also, during the insertion of the known fixation pins impinged by spring force into the telescopic tubes, the pins can easily tilt, or jam, and furthermore scratch the inner wall. The jamming renders the assembly at different locations considerably more difficult.

It is therefore desirable to provide a fixation pin that solves the aforementioned problems.

SUMMARY OF THE INVENTION

The present invention provides a coupling spring pin comprising a base spring element and a bolt connected to the spring element. The spring element is provided with a flange and at least two bent spring tongues. The bolt stands perpendicularly on the flange and the two bent spring tongues extend downwards from the flange. The spring element may be made of a plastic material, preferably a polyoxymethylene (POM) material.

The bolt may be provided with a bolt case in order to securely prevent shearing. The bolt case, in its lower region, may be provided with an annular groove and the bolt case may be peripherally molded on the base in an injection molding tool, so that the plastic material of the flange may fill out the annular groove, thereby allowing the bolt case to be connected to the spring element in an undetachable and stable manner.

The spring tongues of the coupling spring pin may be bent in opposite directions and each tongue has the shape of an approximate quarter circle so that an approximately horizontal lower sliding surface is formed in each case at the base ends of the spring tongues. The spring tongues may be integrally formed on the flange in a manner such that the force exerted on a bolt tip is transmitted further along the bolt's longitudinal axis and is introduced into the spring tongues approximately tangentially. The bolt may be provided with an inner plastic core, and plastic material on the bolt tip which forms a press point which is accentuated with regard to color.

When the coupling spring pin is being applied to a telescopic tube, the maximal width of the spring tongues of the spring pin approximately corresponds to the width of a narrowest location between the inner walls in the hollow section of the telescopic tube so that the spring tongues are prevented from slipping away transversely to their spreading (expansion) direction. The height of the spring element is dimensioned so that the spring tongues are slightly pre-stressed when the spring pin is being applied to the telescopic tube. Some examples of the telescopic tube include, but are not limited to, height-adjustable support legs, corner posts, and length-adjustable transverse struts of collapsible tents.

BRIEF DESCRIPTION OF THE DRAWINGS

Preferred embodiments of the present invention are described in detail below and illustrated in the drawings, in which.

DETAILED DESCRIPTION OF THE INVENTION

Figure 1:
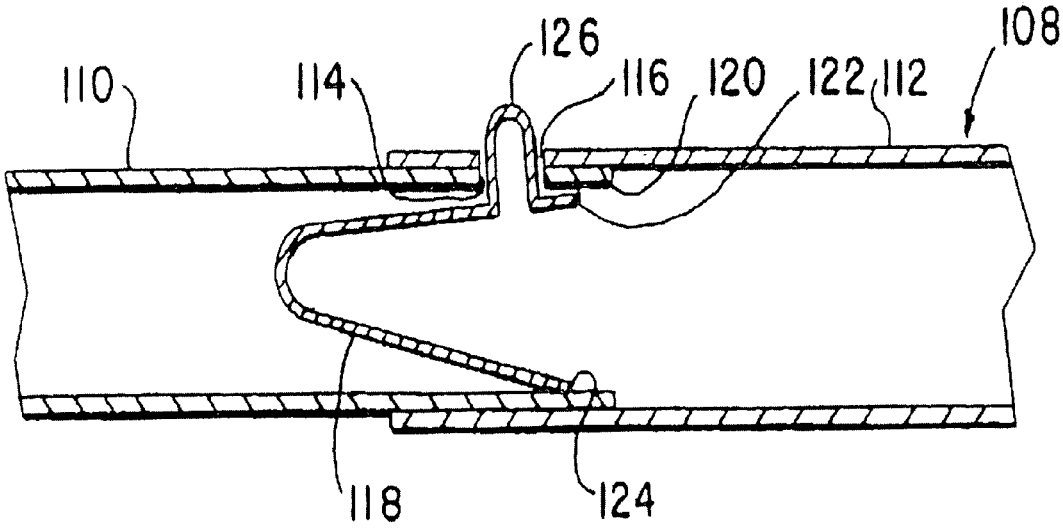
FIG. 1 shows a cross sectional view of a prior art fixation pin, impinged by spring force, and arranged in a rectangular telescopic tube system.
Figure 2:
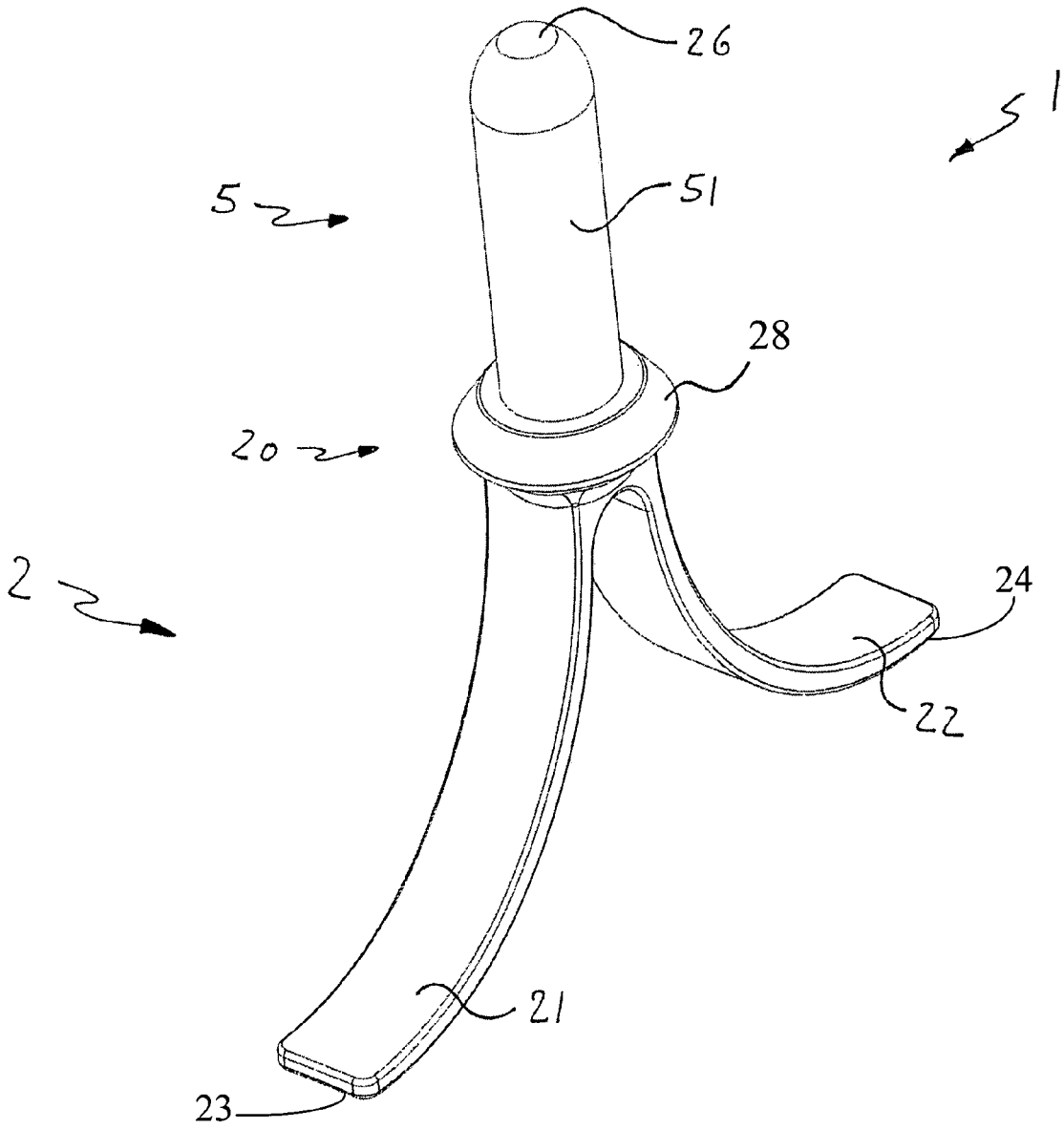
FIG. 2 shows a perspective view of an embodiment of the spring pin of the present invention.
Figure 3:
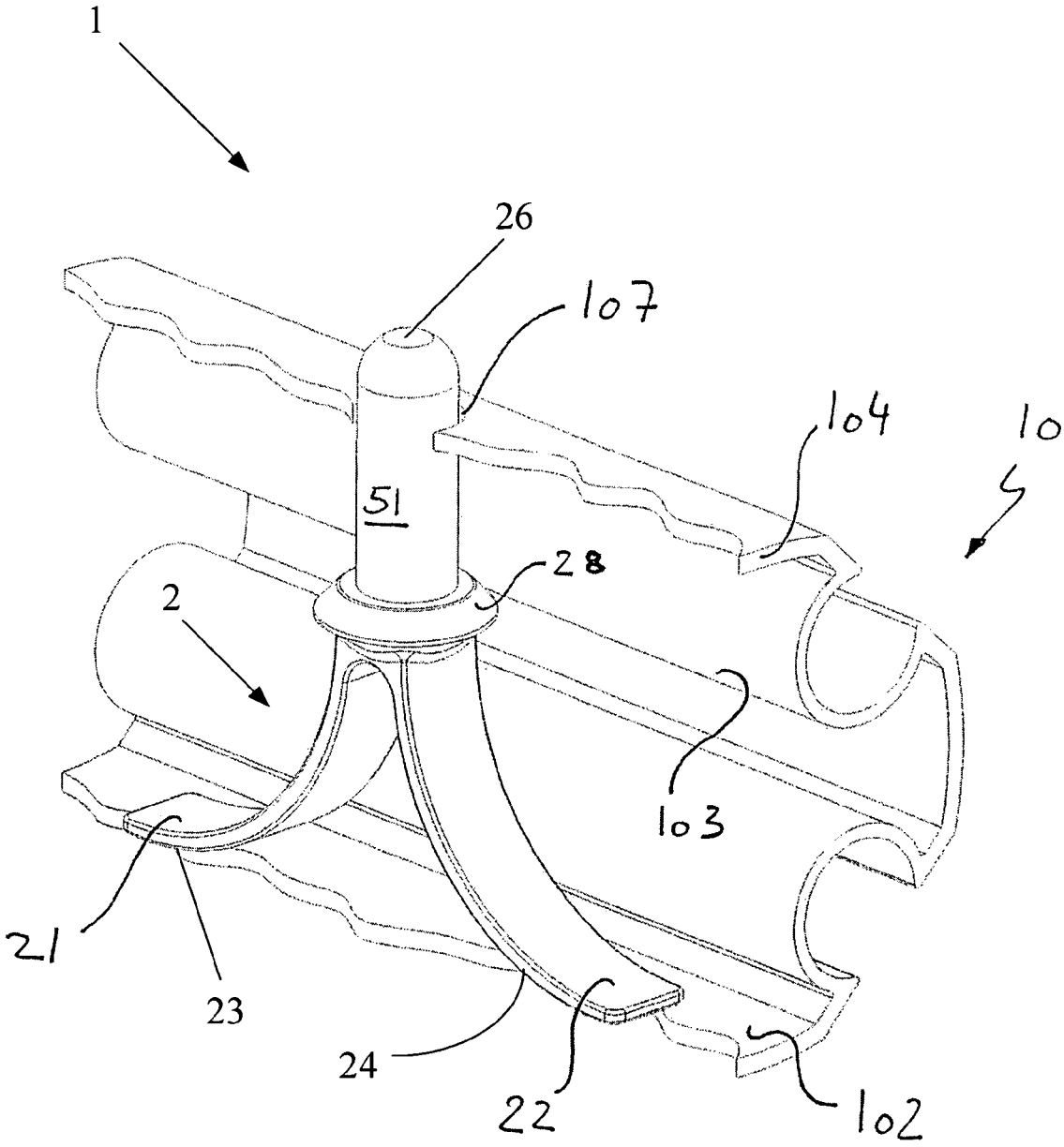
FIG. 3 shows the spring pin of FIG. 2, arranged in a telescopic tube, wherein the wall of the tube has been partly omitted and shortened.

An embodiment of the coupling spring pin 1 of the present invention is shown in FIG. 2. A base spring element 2 constructed of an elastomer, preferably a polyoxymethylene (POM) material, carries a cylindrical bolt 5 which is rounded off at its upper end. The bolt 5 is preferably provided with a cylindrical metal bolt case 51 in order to reliably prevent a shearing even with heavy loads. The cylindrical bolt 5 stands perpendicularly on a circular disk shaped flange 20 which comprises a peripheral abutment collar 28. Two bent spring tongues 21, 22 extend downwards from the flange 20. The spring tongues 21, 22 are bent in opposite directions and each tongue has the shape of an approximate quarter circle so that an approximately horizontal lower sliding surface 23, 24 is formed in each case at the base ends of the spring tongues 21, 22. When the coupling spring pin 1 is applied, these sliding surfaces 23, 24, as shown in FIG. 3, may come to bear on an inner wall 102 of a telescopic tube 10. The spring tongues 21, 22 are spread out by way of pressure on the tip of the bolt 5, and the sliding surfaces 23, 24 permit the sliding apart and the partial rolling of the spring tongues 21, 22 on the inner wall 102 of the telescopic tube 10. If the user of the coupling spring pin 1 presses on the bolt tip 26, then the exerted force is transmitted along the longitudinal axis of the bolt 5 and is introduced approximately tangentially into the flange-side end regions of the spring tongues 21, 22. The force exerted on the bolt 5 is accommodated in equal parts by way of the approximately circular arc shaped curved spring tongues 21, 22, and the force is further transmitted and is largely stored due to the deformation of the spring tongues 21, 22. As soon as the pressure on the bolt 5 is reduced or is completely relieved, the two spring tongues 21, 22 again assume their initial shape and push the bolt 5 perpendicularly upwards into a locking position. The widely spread (expanded) design of the spring tongues 21, 22 and their bilateral symmetry essentially prevents the fixation pin from slipping away on the inner wall 102 of a telescopic tube 10.

Since the spring element 2 is manufactured of a plastic material, preferably POM, the spring tongues 21, 22 may slide and rub on the inner wall 102 of the telescopic tube 10 without an abrasion of the tube material occurring.

Figure 4:
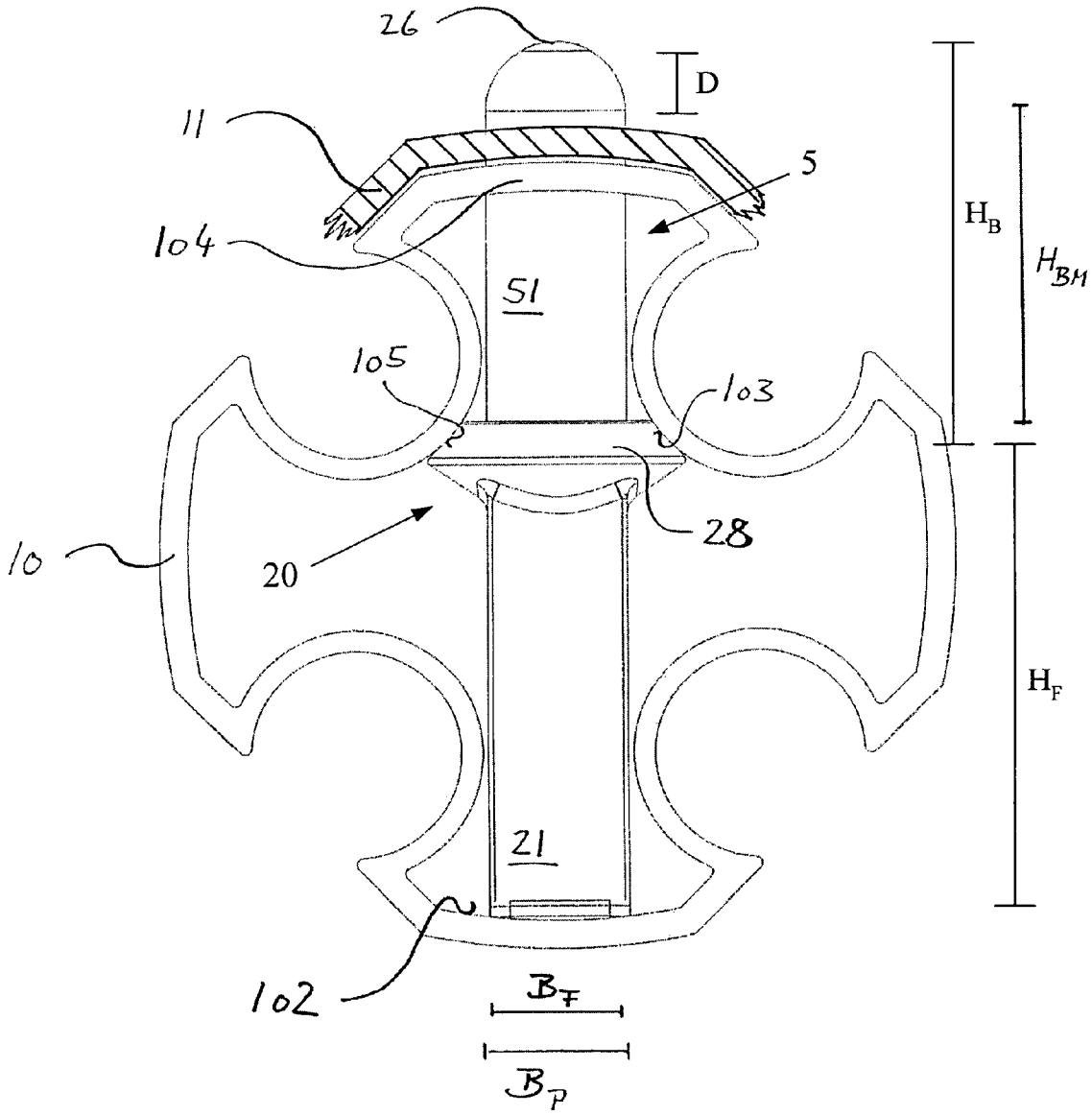
FIG. 4 shows a cross-sectional view of the spring pin coupled to a telescopic tube, wherein the outer telescopic tube is sectioned and is only partly shown.

In FIGS. 3 and 4, an embodiment of the spring pin 1 is shown in the inserted condition. The spring pin 1 is preferably sized to fit telescopic hollow sections 10, 11 as follows. The width $B_F$ of the spring tongues 21, 22 corresponds roughly to the width $B_P$ of the narrowest location between the inner walls 102 in the hollow section 10. The height $H_F$ of the spring element 2 is dimensioned such that the spring tongues are slightly pre-stressed (initially loaded) in the applied condition. The height $H_B$ of the bolt 5 is dimensioned such that the bolt 5 projects out of the tube accommodating it by a path D which is smaller than the maximal spring path of the spring element 2, so that the bolt 5 may be pressed at least so far into the tube that its tip 26 comes to bear with the outer wall 104 in a flush manner. The height clearance $H_{BM}$ of the cylindrical metal bolt case 51 is dimensioned such that the cylindrical bolt case 51 projects out of the inner tube 10 by at least the wall thickness of the tubes 10, 11. The diameter of the flange 20 is dimensioned such that at least one of the inner surface regions 103, 105 of the accommodating section 10 limits the vertical displacement movability of the flange 20 and the bolt 5, acting as an abutment surface.

The fact that the width $B_F$ of the spring tongues 21, 22 corresponds roughly to the width $B_P$ of the narrowest location between the inner walls 102 in the hollow section ensures that the spring tongues 21, 22 may not slip away transversely to the spreading (expansion) direction. For a telescopic tube having an octagonal section with keder grooves, the shape of the spring tongues 21, 22 is thus relatively slim. For a telescopic tube having a rectangular section, as shown in FIG. 2, the width of the tongues 21, 22, in the region of the sliding surfaces 23, 24, is preferably approximately equal to the width of the rectangular section.

The height $H_F$ of the spring element 2 ensures that the bolt 5 of the spring pin 1 is situated securely in the locked position when the external force effect is absent and may not wobble or rattle in the section 10.

Due to the height $H_B$ of the bolt 5, the bolt 5 may be completely sunk in the section 10 by way of a suitable pressure, so that an outer section 11 may be pushed over this. The bolt tip 26 is rounded and is preferably manufactured of plastic so that wear on the inner wall of the outer section 11 may not occur. The spring pin 1 on insertion into the section 10 may even be pressed so that it is inserted without any problem from one end into the section tube 10, 11 and is then pushed by way of a suitable rod until in the envisaged position along the longitudinal axis of the tube.

In the embodiment of FIG. 4 where tube 10 has a complex section geometry, the height of the bolt and the flange diameter are matched to one another so that the flange 20, with its peripheral abutment collar 28, comes to lie on the inner walls of the two keder grooves 103, 105. The keder grooves 103, 105 are arranged adjacent to the section wall 104 through which the bolt 5 passes. The abutment collar 28 is preferably inclined so that it comes to bear on the inner walls of the two keder grooves 103, 105 approximately over the complete surface.

In a simple rectangular section as shown in FIG. 3, the diameter of flange 20 only needs to be larger than the bore 107 accommodating the bolt 5 so that the inner side of the section wall 104, which surrounds the bore 107, serves as an abutment surface.

The height clearance $H_{BM}$ of the cylindrical metal bolt case 51 ensures that when the bolt 5 in its locking position, its circularly cylindrical case region 51 comes to bear on the parallel running inner walls of the corresponding bores 107 of the inner 10 section tube and the outer 11 section tube. The clamping force acts perpendicularly to the case surface and the bolt 5 may not be pressed inwards. The metal bolt case 51 reliably prevents the bolt 5 from being sheared even with large force loads.

Figure 5:
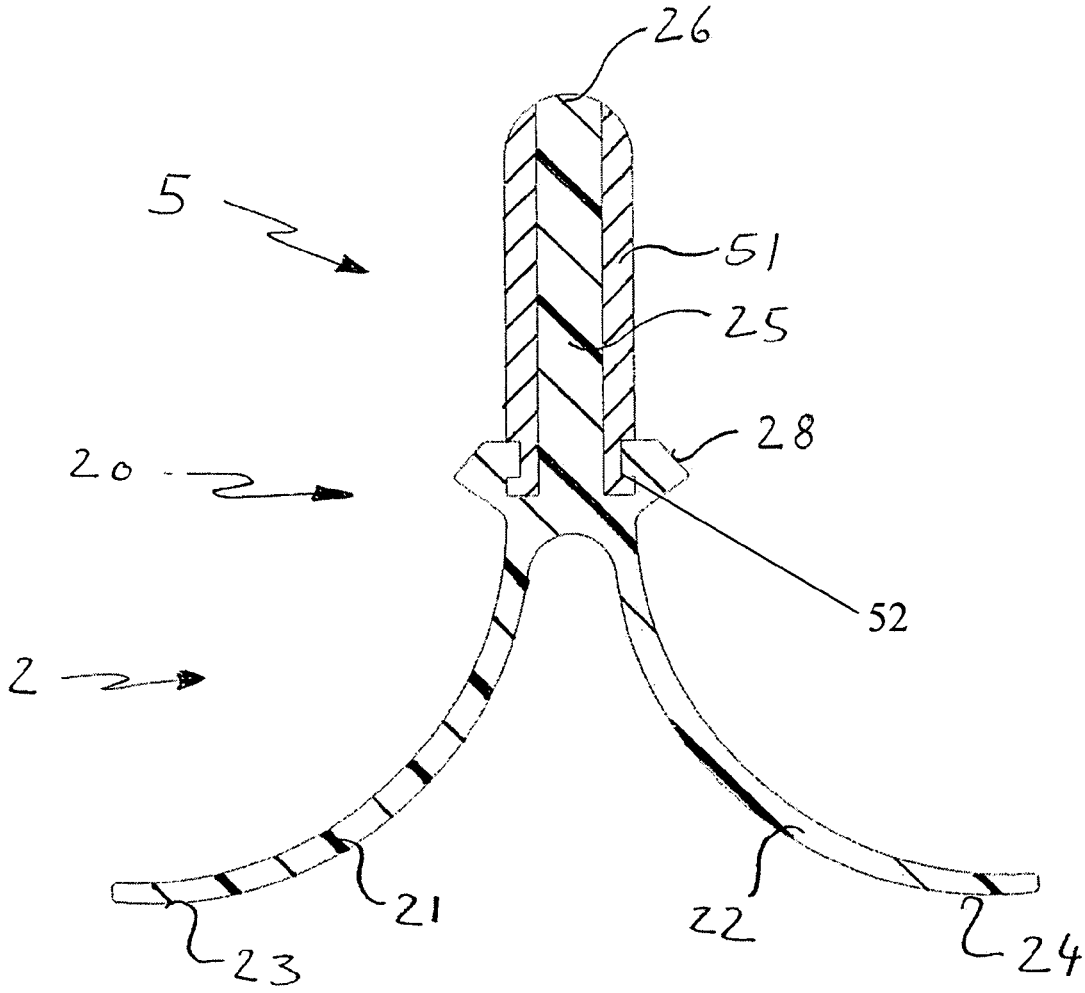
FIG. 5 shows a front view of the longitudinal section of an inventive spring pin.

The longitudinal section of the spring pin shown in FIG. 5 illustrates how the metal bolt case 51 is held on the spring element 2. In this embodiment, the bolt case 51 is provided with an annular groove 52 in its lower region. The hollow bolt case 51 is peripherally molded on the base in an injection molding tool, so that the plastic material of the flange 20 fills out the annular groove 52 and the bolt case 51 is connected to the spring element 2 in an undetachable and stable manner. Since the bolt case 51 is hollow on the inside and open at its tip 26, the preferably colored plastic material, on injection molding, may completely fill out the bolt case 51 and forms a plastic core 25. The plastic material, preferably POM material, exits at the bolt tip 26 and forms a push point which is accentuated with regard to color. The tip 26, as described above, is preferably crowned. Due to the plastic material, the friction between the tip 26 and the inner wall of an outer telescopic tube is greatly reduced when the inner and outer telescopic tubes 10, 11 are moved with respect to each other. This simplifies the mutual displacement of the telescopic tubes 10, 11 when the spring pin 1 is pressed.

Figure 6:
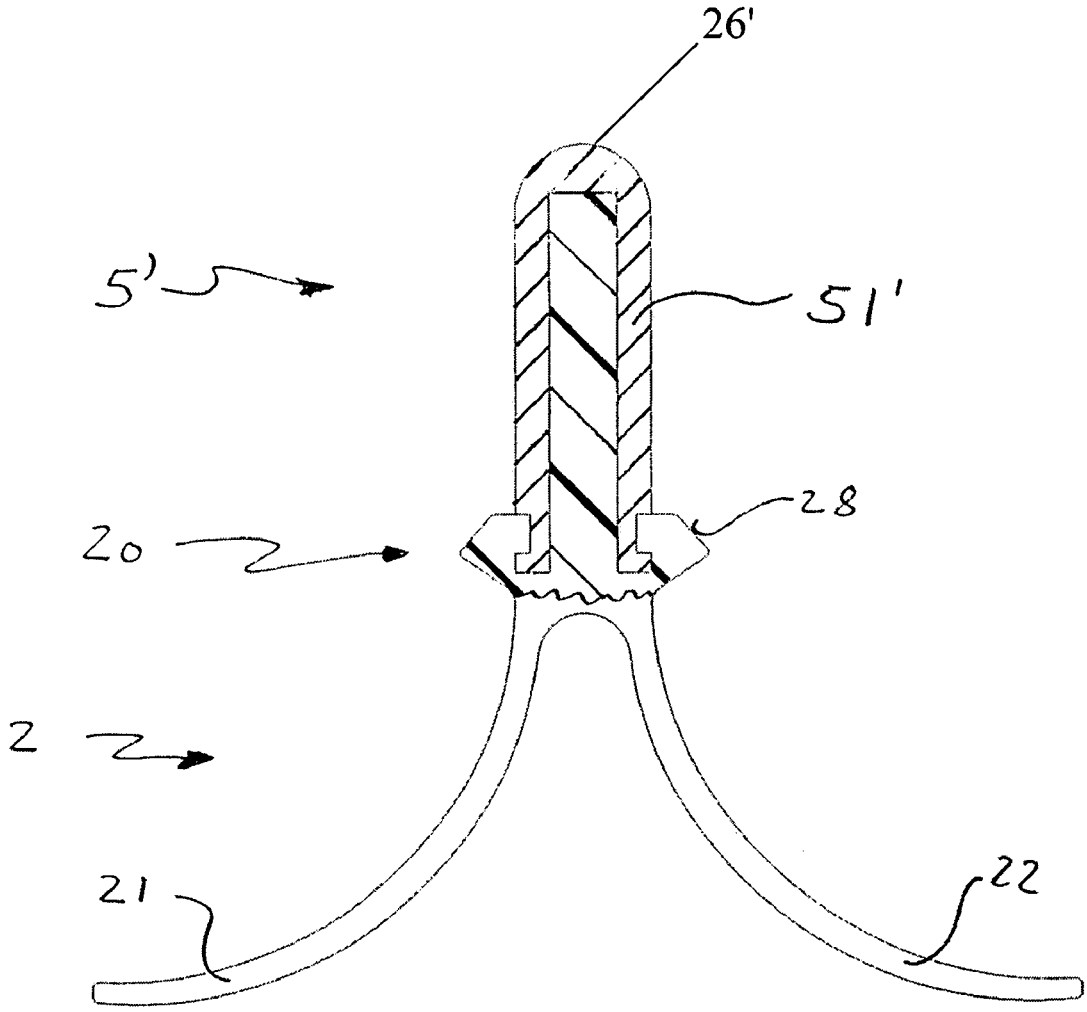
FIG. 6 shows a front view of the longitudinal section of a further embodiment of the inventive spring pin.

A further embodiment of the spring pin of the present invention is shown in FIG. 6. In this embodiment, the bolt case 51' is closed at its tip 26'. This embodiment of the coupling spring pin is preferably used in outer sections 11 for locking attachment elements or plastic slides which are assembled in a displaceably movable manner. Thus, a rubbing of the metallic tip of the bolt 5 on an inner tube wall may not occur.

I claim:

1. A coupling spring pin comprising:

(a) a base spring element made of a plastic material and comprising a flange and at least two bent spring tongues extending downwards from the flange; and (b) a bolt connected to the spring element extending upwardly perpendicularly from the flange opposite the spring tongues and comprising an inner core unitarily formed of the plastic material and an outer cylindrical bolt case made of metal abutting the flange, wherein the bolt case has an opening at each of its longitudinal end regions and the plastic material of the inner core protrudes from the openings at the longitudinal end regions, and wherein the bolt case is provided with an annular groove in its lower region abutting the flange and the plastic material of the flange extends upwardly and annularly wraps around the longitudinal end of the bolt case abutting the flange and fills the annular groove, thereby connecting the bolt case to the spring element in an undetachable and stable manner.

2. The coupling spring pin of claim 1, wherein the plastic material is a polyoxymethylene material.

3. The coupling spring pin of claim 1, wherein the spring tongues are bent in opposite directions and each tongue has the shape of an approximate quarter circle whereby an approximately horizontal lower sliding surface is formed at a base end of each spring tongue.

4. The coupling spring pin of claim 3, wherein the spring tongues are integrally formed on the flange whereby a force exerted on a bolt tip is transmitted along a longitudinal axis of the bolt and is introduced into the spring tongues approximately tangentially.

5. An article comprising at least two hollow tubes capable of being displaced in one another in a telescopic manner and a coupling spring pin of claim 1, wherein a maximal width of the spring tongues approximately corresponds to a width of a narrowest location between inner walls of at least one of the telescopic tubes so that the spring tongues are prevented from slipping away transversely to their spreading direction, when inserted in the tube.

6. The article of claim 5, wherein the height of the spring element is dimensioned such that the spring tongues are slightly pre-stressed when the spring pin is applied to the telescopic tube.

7. The article of claim 5, wherein the at least two telescopic tubes are selected from the group consisting of: height-adjustable support legs, corner posts, and length-adjustable transverse struts of collapsible tents.

8. A coupling spring pin comprising:

(a) a base spring element made of a polyoxymethylene material and comprising a flange and at least two bent spring tongues extending downwards from the flange; and (b) a bolt connected to the spring element extending upwardly perpendicularly from the flange opposite the spring tongues and comprising an inner core unitarily formed of the polyoxymethylene material and an outer cylindrical bolt case made of metal abutting the flange wherein the bolt case has an opening at each of its longitudinal end regions and the polyoxymethylene material of the inner core protrudes from the openings at the longitudinal end regions, and wherein the bolt case is provided with an annular groove in its lower region abutting the flange and the polyoxymethylene material of the flange extends upwardly and annularly wraps around the longitudinal end of the bolt case abutting the flange and fills the annular groove, thereby connecting the bolt case to the spring element in an undetachable and stable manner.

9. The coupling spring pin of claim 8, wherein the spring tongues are bent in opposite directions and each tongue has the shape of an approximate quarter circle whereby an approximately horizontal lower sliding surface is formed at a base end of each spring tongue.

10. The coupling spring pin of claim 8, wherein the spring tongues are integrally formed on the flange whereby a force exerted on a bolt tip is transmitted along a longitudinal axis of the bolt and is introduced into the spring tongues approximately tangentially.

11. A coupling spring pin comprising:

(a) a base spring element made of a plastic material and comprising a flange and at least two bent spring tongues extending downwards from the flange; and (b) a bolt connected to the spring element extending upwardly perpendicularly from the flange opposite the spring tongues and comprising an inner core unitarily formed of the plastic material and an outer cylindrical bolt case made of metal abutting the flange wherein the bolt case has an opening at each of its longitudinal end regions and the plastic material of the inner core protrudes from the openings at the longitudinal end regions, wherein the spring tongues are bent in opposite directions and each tongue has the shape of an approximate quarter circle whereby an approximately horizontal lower sliding surface is formed at a base end of each spring tongue, and wherein the bolt case is provided with an annular groove in its lower region abutting the flange and the plastic material of the flange extends upwardly and annularly wraps around the longitudinal end of the bolt case abutting the flange and fills the annular groove, thereby connecting the bolt case to the spring element in an undetachable and stable manner.

12. The coupling spring pin of claim 11, wherein the tip is crowned.

* * * * *